United States Patent [19]

Walker et al.

[11] Patent Number: 4,911,433

[45] Date of Patent: Mar. 27, 1990

[54] WEIGHTED ATHLETIC GLOVE

[76] Inventors: John D. Walker, 9447 Fountainbleau Blvd., #208, Miami, Fla. 33172; Larry Martin, 7918 3rd Ave. S., St. Petersburg, Fla. 33707

[21] Appl. No.: 290,974

[22] Filed: Dec. 28, 1988

[51] Int. Cl.[4] ..... A63B 21/00

[52] U.S. Cl. ..... 272/119; 2/161 A

[58] Field of Search ..... 272/67, 93, 96, 119; 2/159, 160, 161 R, 161 A, 162, 170

[56] References Cited

U.S. PATENT DOCUMENTS

| | | | |
|---|---|---|---|
| 3,149,839 | 9/1964 | Materia | 272/119 X |
| 3,203,006 | 8/1965 | Shirey | 272/119 X |
| 3,588,105 | 6/1971 | Donohoe | 272/119 X |
| 3,838,853 | 10/1974 | Fredenhagen | 272/67 |
| 3,924,851 | 12/1975 | Winston | 272/67 |
| 4,247,097 | 1/1981 | Schwartz | 272/119 |
| 4,632,389 | 12/1986 | Moss | 272/119 |
| 4,684,123 | 8/1987 | Fabry | 272/119 |
| 4,823,778 | 4/1989 | Ewing | 272/119 X |
| 4,846,464 | 7/1989 | Jorno | 272/119 |

FOREIGN PATENT DOCUMENTS

| | | | |
|---|---|---|---|
| 97224 | 6/1924 | Austria | 272/119 |

*Primary Examiner*—Richard J. Apley
*Assistant Examiner*—Robert W. Bahr
*Attorney, Agent, or Firm*—Ronald E. Smith; Joseph C. Mason

[57] ABSTRACT

A weighted glove. A plurality of small weight members are secured to a glove at preselected locations throughout the breadth and extent of the glove. Heavier weight members are secured to the hand part of the glove and lighter weight members are secured to the finger parts of the glove. The weight members on the hand part of the glove are in general alignment with the finger parts of the glove.

41 Claims, 2 Drawing Sheets

10
12
14
16
18
20
22
24
26
28
30
32
34
36
38
40
42
44
46
48
50
52
54
55
56
57
58
60
62
64
66
68
70
72
74
76
78
80
82
84
86
88
90

WEIGHTED ATHLETIC GLOVE

TECHNICAL FIELD

This invention relates, generally, to the field of athletic training equipment. More particularly, it relates to a glove worn by baseball players desiring to improve their hitting ability by increasing their hand speed.

BACKGROUND ART

The present inventors, students of the art of baseball hitting, have observed that the difference between a good hitter and an average hitter involves hand speed, i.e., above average hitters have more hand speed than average hitters.

The quickness of one's hands depends to a large extent upon the strength of one's hands. Players with weak hands are unable to swing the bat with as much speed as those players with stronger hands.

Unfortunately, no effective training equipment has been heretofore developed that enables a batter to develop his or her hand speed. Instead, batting coaches have traditionally instructed poor and average batters to simply practice more. While practice does strengthen one's hands and thus enable one to swing the bat through the strike zone faster, it does not normally result in greatly enhanced batting statistics. Thus, coaches often conclude that some players are simply more talented than others whereas the purported talent may be nothing more than stronger hands.

A weighted glove is shown in U.S. Pat. No. 4,042,975 to Elliott, Jr., et al. (1977); the weights are plate members intended to protect the batter's hands from pitches and, as such, the glove has little or no utility in connection with batting practice.

Other weighted exercise gloves, none of which can be effectively worn by baseball players during batting practice for practical reasons, are shown in the following U.S. Pat. Nos.: 3,838,853 to Fredenhagen (1974); 4,034,979 to Wester (1977); 4,247,097 to Schwartz (1981); 4,253,660 to Tiktin (1981); 4,326,706 to Guthrie, et al. (1982); 4,330,120 to Netti (1982); 4,556,215 to Tarbox, et al. (1985); 4,575,075 to Tarbox, et al. (1986); and 4,684,123 to Fabry (1987).

Until such time as a weighted glove that meets the needs of baseball hitters is provided, there will be no training equipment that will allow slow batting speed hitters to improve their skills.

DISCLOSURE OF INVENTION

The present invention is a unique weighted glove that pioneers the art of athletic equipment that is effective to increase the and speed of hitters. The glove is worn during batting practice, soft-toss and use of a batting T, i.e., it is not worn during a regulation game.

The glove, known commercially as the Quickhands (trademark) batting practice glove, is an all leather glove; a plurality of small lead weights are fixedly but releasably secured to the top of the glove at carefully preselected locations. The preferred commercial embodiment of the glove includes 19 weights; quarter ounce weights are provided on the finger parts of the glove, whereas half ounce weights are provided on the hand part thereof.

The commercial embodiment has a total added weight of eight ounces, but the total amount of weights can be reduced for young, inexperienced players, and increased for those experienced players already having at least average hand speed.

It will thus be seen that the primary object of this invention is to pioneer the art of batting practice gloves for baseball players by providing a specifically designed weighted glove, the use of which will give the player quick hands.

The invention accordingly comprises the features of construction, combination of elements and arrangement of parts that will be exemplified in the descriptions set forth hereinafter and the scope of the invention will be set forth in the claims.

BRIEF DESCRIPTION OF DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
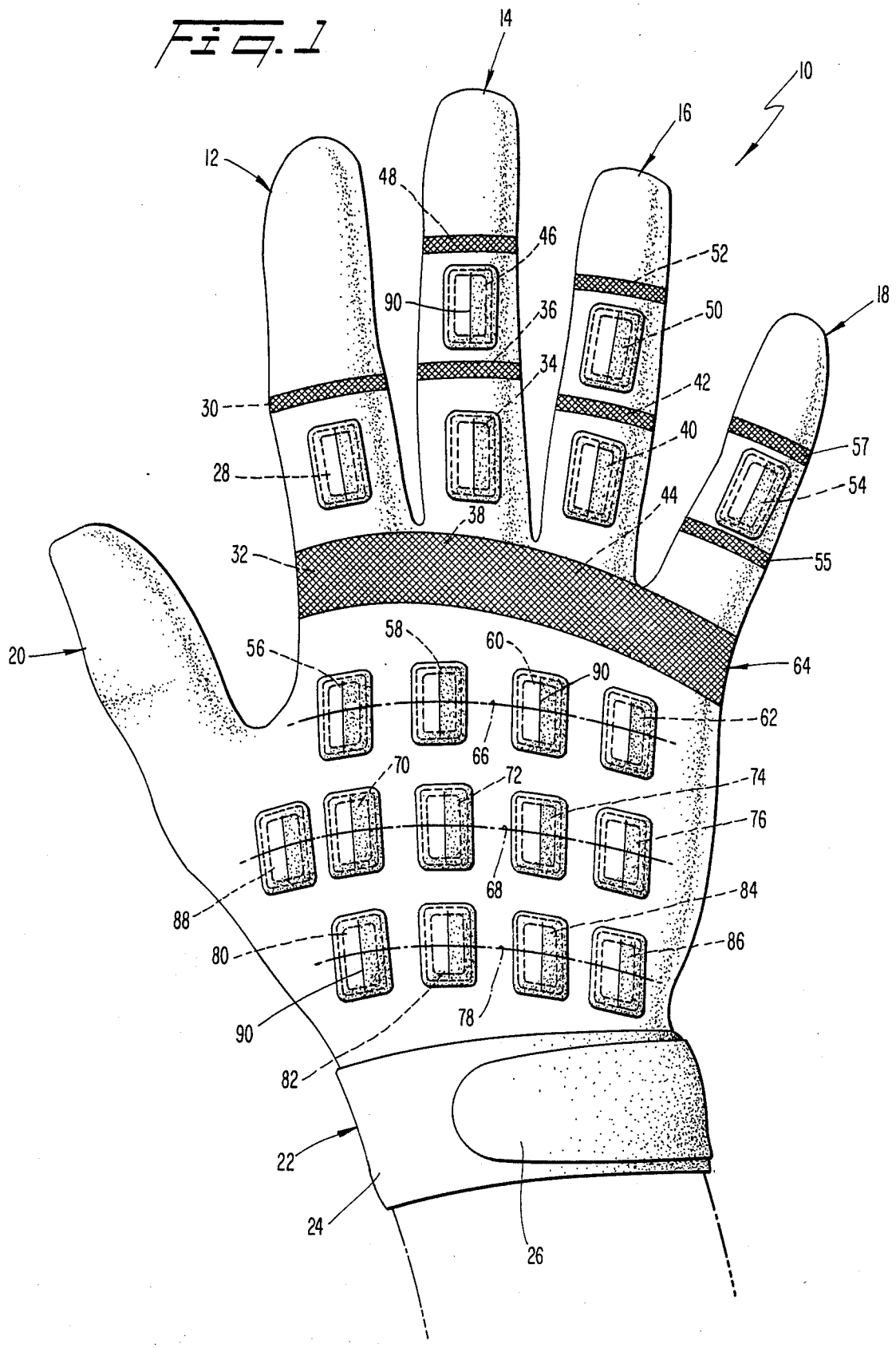
FIG. 1 is a top plan view of the top side of a right hand glove, built in accordance with the teachings and suggestions of the present invention; a left hand glove, not shown, has a symmetrical construction.

Referring now to FIG. 1, it will there be seen that a glove that illustratively embodies the present invention is denoted by the reference numeral 10 as a whole.

The finger parts of the glove are denoted 12, 14, 16 and 18 and the thumb part thereof is denoted 20. The wrist part 22 includes a bottom part 24 having a fastening means (not shown) of the hook type and a top part 26 having a fastening means (not shown) of the loop type so that when top part 26 is brought into overlying relation to bottom part 24, the hooks and loops will engage in the well known manner to releasably close wrist part 22 of glove 10. The preferred hook and loop fastening means is the Velcro (trademark) hook and loop fastening device.

Index finger 12 is provided with a single weight member 28 positioned on the top side of the glove as shown. Specifically, when the glove is worn, the weight member 28 will overlie the index finger of the batter and will be midway between the interphalangeal joint 30 of the finger (not shown) and the metacarpophalangeal joint 32 thereof.

Similarly, weight member 34 on glove middle finger 14 will overlie the medial point between the interphalangeal joint 36 of the batter's middle finger (not shown) and the metacarpophalangeal joint 38 thereof, and weight member 40 will overlie the midpoint between the interphalangeal joint 42 of the ring finger (not shown) in glove finger 16 and the metacarpophalangeal joint 44 of the ring finger.

Weight member 46 is fixedly secured to glove middle finger 14 as depicted between interphalangeal joint 36 and distal interphalangeal joint 48 of the middle finger.

Similarly, weight member 50 is intermediate inter flangeal joint 42 and distal interphalangeal joint 52 of the ring finger in glove ring finger 16.

Weight member 54, on glove little finger 18, is disposed between and corresponds to the interphalangeal joint 55 and distal interphalangeal joint 57 of the little finger, not shown.

Weight members 28, 34, 40, 46, 50 and 54 are all one-quarter ounce in weight and may be increased or decreased for inexperienced or advanced players, respectively.

FIG. 1 is substantially an actual size drawing; thus the preferred weight placements are as shown. These placements serve to center the weight members with respect to the corresponding parts of the fingers disposed in the respective finger parts of glove 10.

Referring now to the hand part 54 of glove 10, it will there be seen that weight members 56, 58, 60 and 62 are each spaced about one-half inch from the metacarpophalangeal joint of the index, middle, ring and little fingers, respectively, as shown, and in general, although not precise, axial alignment therewith.

Due o the physiology of the human hand, the metacarpophalangeal joint region of glove 10, denoted in FIG. 1 as a whole by the reference numeral 64, is slightly arcuate in configuration. Thus, the respective longitudinal mid-points of weight members 56, 58, 60 and 62, since they are arranged in a common, fixed spaced relation thereto as aforesaid, also lie on a slightly arcuate imaginary line denoted 66 in the Fig.

A similar imaginary arcuate line 68 interconnects the longitudinal mid-portions of weight members 70, 72, 74 and 76, respectively as shown, and imaginary arcuate line 78 does the same for weight members 80, 82, 84 and 86.

Each weight member is about one-quarter inch in width and about one-half inch in length, and may have rounded corners as shown and a rounded, oval or dome-shaped top.

It is important to note that weight members 28, 56, 70 and 80 are all in general longitudinal alignment with glove index finger 12, that weight members 34, 46, 58, 72 and 82 are in general longitudinal alignment with glove middle finger 14, that weight members 40, 50, 60, 74 and 84 are in general longitudinal alignment with glove ring finger 16, and that weight members 54, 62, 76 and 86 are in general alignment with glove little finger 18.

An additional weight member 88 is not in general longitudinal alignment with any glove finger; instead, it is positioned to the left of weight member 70 as shown and, as such, adds weight to that part of glove 10 near the base of the thumb part 20 thereof.

All of the weight members could be permanently secured to glove 10 by overlying each weight member with a small piece of suitable material and sewing the material to the glove to thereby permanently encase each weight member.

However, such creating of pockets for the weight members would require thread removal and re-sewing whenever the weights in a glove were to be changed.

Figure 3:
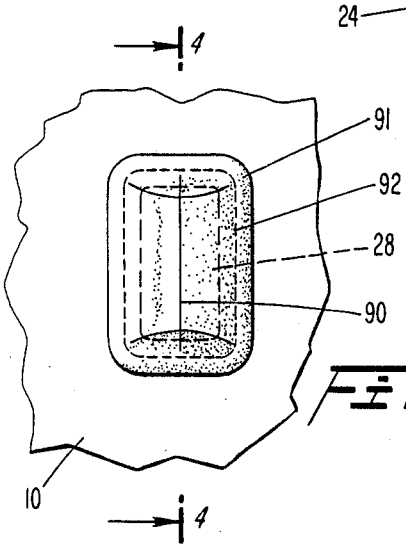
FIG. 3 is a top plan view of a weight member disposed in a retainer means.
Figure 4:
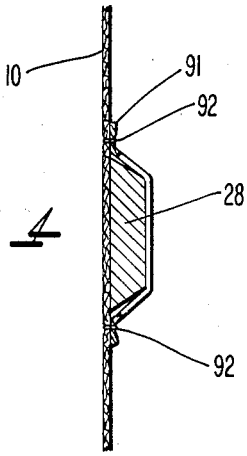
FIG. 4 is a sectional view taken along line 4—4 in FIG. 3.

Accordingly, longitudinally aligned slits, collectively designated 90, are formed in each piece of material as shown in FIGS. 1, 3 and 4. When the player's hand is held flat as in FIG. 1, each slit 90 permits easy access to a weight member so that weight removal or replacement can be quickly and easily accomplished. Advantageously, when the player tightens his or her grip around a bat, the slits 90 will close tightly and retain the weights securely in place.

In FIGS. 3 and 4, the material overlying a weight member is denoted 91 and the the thread that sews material 91 to glove 10 is denoted 92.

Figure 5:
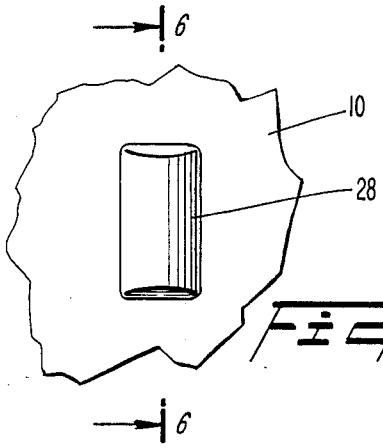
FIG. 5 is a top plan view of a weight member.
Figure 6:
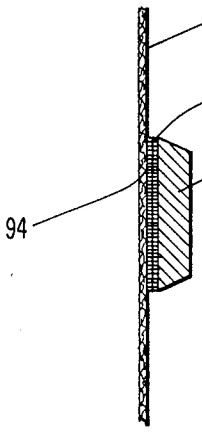
FIG. 6 is a sectional view taken along line 6—6 in FIG. 5.

FIGS. 5 and 6 depict an alternative means for securing a weight member to its particular position on glove 10; no material 91 is employed in this embodiment. Instead, as shown in FIG. 6, a base member 94 of the hook and loop fastening type is permanently bonded to glove 10 and a similar hook and loop type fastener 96 of mating structure is permanently bonded to the bottom of each weight member. Thus, as is clear from FIG. 6, each weight member will be securely but releasably secured to glove 10 as desired.

The hook and loop fastening means also provides a shock-absorbing function in that it protects the hands of the wearer if a weight member is struck by a projectile such as a baseball. Other shock-absorbing means could be provided as well. For example, a thin sheet of rubber or other elastomeric material could be disposed in underlying relation to each weight member.

Figure 2:
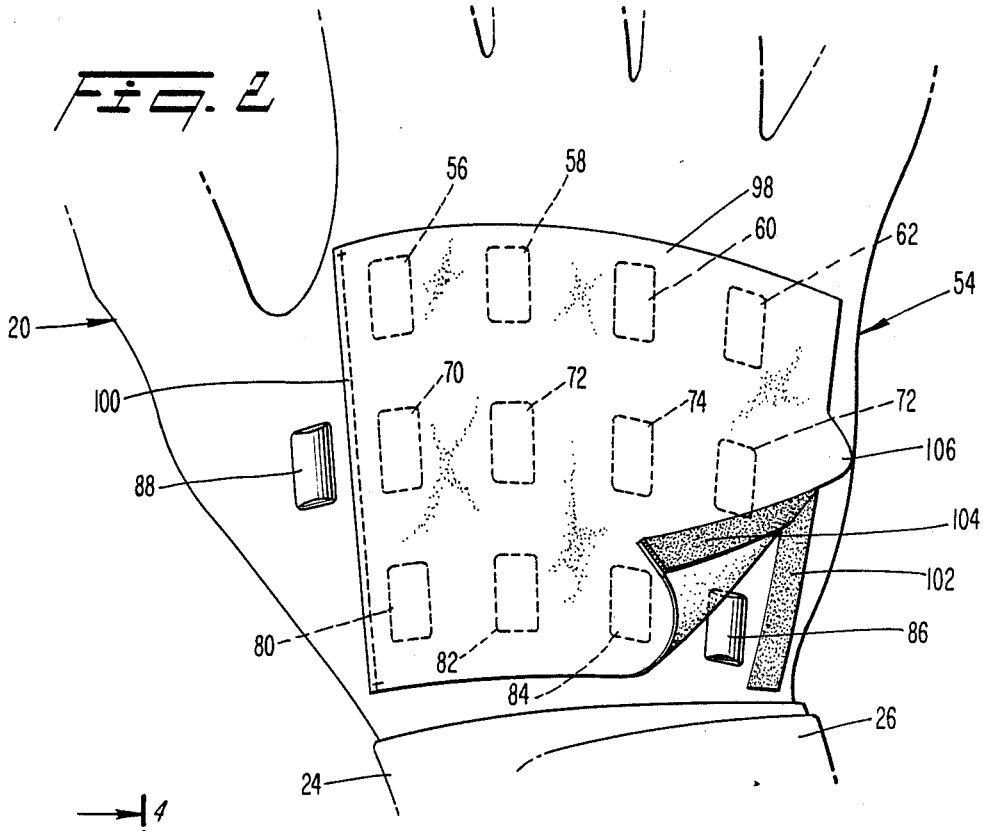
FIG. 2 is a partial top plan view of a second embodiment of the invention.

Another embodiment of the invention is shown in FIG. 2. A flexible flap member 98 is preferably sewed as at 100 to the thumb side of glove 10 and as such is hingedly mounted thereto. A strip of hook and loop type fastening material 102 is permanently secured to the opposite or little finger side of the glove. A mating strip of hook and loop fastening material 104 is permanently secured to the bottom side of flap 98 as shown and a tab means 106 facilitates the opening and closing of the flap. When closed, the flap provides additional means for securing in place the weight members on the hand part of the glove. It also provides a convenient substrate for imprinting the brand name "Quickhands" thereon. When flap 98 is used, the weight members can be primarily secured as in the embodiment of FIGS. 1, 3 and 4 or as in the embodiment of FIGS. 5 and 6.

The specific positioning of weight members disclosed herein has been scientifically selected, each weight member's position being related to a specific finger joint or in line with a finger or thumb as mentioned. The distribution of the weight members is carefully selected so as to evenly and advantageously distribute the collective weight of the glove.

Tests of the novel glove have shown that its use greatly increases the hand speed of all batters, whether poor, average or above average.

INDUSTRIAL APPLICABILITY

Baseball, the American national pastime, has become an Olympic sport and is in the process of becoming the international pastime. The present invention enables everyone desiring to play the game to acquire good batting skills, and thus increases the enjoyment of the game for players and spectators alike, although pitchers may appreciate this invention to a lesser extent.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A weighted glove member having a thumb-receiving part, four finger-receiving parts, and a hand-receiving part, all of said parts having a palm side and a back side, comprising:

a first plurality of discrete weight members being fixedly secured to the back side of different finger-receiving parts of said glove member;

a second plurality of discrete weight members being fixedly secured to the back side of different areas of said handreceiving part of said glove member;

each of said weight members being generally rectangular in configuration;

each of said weight members being about one-quarter inch in width and about one-half inch in length; and each of said weight members being spaced apart from one another a sufficient distance to permit substantially uninhibited flexing of a hand, thumb and plurality of fingers disposed within said glove member and to distribute the combined weight of said weight members throughout the back side of said glove member.

2. A weighted glove member having a thumb-receiving part, four finger-receiving parts, and a hand-receiving part, all of said parts having a palm side and a back side, comprising:

a first plurality of discrete weight members being fixedly secured to the back side of different finger-receiving parts of said glove member;

a second plurality of discrete weight members being secured to the back side of different areas of said hand-receiving part of said glove member;

each of said weight members being generally rectangular in configuration;

each of said weight members being spaced apart from one another a sufficient distance to permit substantially uninhibited flexing of a hand, thumb and plurality of fingers disposed within said glove member and to distribute the combined weight of said weight members throughout the back side of said glove member;

said second plurality of weight members collectively forming a generally square pattern on said hand-receiving part of said glove member;

a flexible flap member of generally square configuration having a first end fixedly secured to said glove member back side adjacent said generally square pattern of weight members;

said flap member having a size sufficient to overlie substantially all of said second plurality of weight members; and means for releasably securing said flap member in tight overlying relation to said second plurality of weight members;

whereby said flap member secures each weight member of said second plurality of weight members in a predetermined position.

3. The glove member of claim 2, wherein said means for releasably securing said flap member in overlying relation to said second plurality of weight members includes a strip of hook and loop fastening material secured to said back side of said hand-receiving part of said glove member adjacent a second side of said generally square pattern of weight members, and wherein a mating strip of said hook and loop material is secured to an underside of said flap member so that said flap member and hence said second plurality of weight members is held securely in place when said mating strips are placed into tight juxtaposition with one another.

4. The glove member of claim 3, comprising:

a first weight member fixedly secured to a first, index finger-receiving part of said glove member;

a second weight member fixedly secured to a second, middle finger-receiving part of said glove member;

a third weight member fixedly secured to a third, ring finger-receiving part of said glove member; and a fourth weight member fixedly secured to a fourth, little finger-receiving part of said glove member.

5. The device of claim 4, further comprising a fifth weight member fixedly to said hand receiving part of said glove member, said fifth weight member being disposed in general longitudinal alignment with said first weight member.

6. The device of claim 5, further comprising a sixth weight member disposed on said hand part of said glove in general longitudinal alignment with said second weight member.

7. The device of claim 6, further comprising a seventh weight member disposed on said hand part of said glove in general longitudinal alignment with said third weight member.

8. The device of claim 7, further comprising an eighth weight member disposed on said hand part of said glove in general longitudinal alignment with said fourth weight member.

9. The device of claim 8, further comprising a ninth weight member disposed on said hand part of said glove in general longitudinal alignment with said first and fifth weight members.

10. The device of claim 9, further comprising a tenth weight member disposed on said hand part of said glove in general longitudinal alignment with said second and sixth weight members.

11. The device of claim 10, further comprising an eleventh weight member disposed on said hand part of said glove in general longitudinal alignment with said third and seventh weight members.

12. The device of claim 11, further comprising a twelfth weight member disposed on said hand part of said glove in general longitudinal alignment with said fourth and eighth weight members.

13. The device of claim 12, further comprising a thirteenth weight member disposed on said hand part of said glove in general longitudinal alignment with said first, fifth and ninth weight members.

14. The device of claim 13, further comprising a fourteenth weight member disposed on said hand part of said glove in general longitudinal alignment with said second, sixth and tenth weight members.

15. The device of claim 14, further comprising a fifteenth weight member disposed on said hand part of said glove in general longitudinal alignment with said third, seventh and eleventh weight members.

16. The device of claim 15, further comprising a sixteenth weight member disposed on said hand part of said glove in general longitudinal alignment with said fourth, eighth and twelfth weight members.

17. The device of claim 16, further comprising a seventeenth weight member disposed on said hand part of said glove in laterally spaced relation to said ninth weight member on the thumb side thereof.

18. The device of claim 17, further comprising an eighteenth weight member disposed on said second, middle finger-receiving part of said glove member in general longitudinal alignment with said second weight member.

19. The device of claim 18, further comprising a nineteenth weight member disposed on said third, index finger-receiving part of said glove member in general longitudinal alignment with said third weight member.

20. The device of claim 19, wherein said fifth, sixth, seventh and eighth weight members are generally laterally disposed with respect to one another.

21. The device of claim 20, wherein said ninth, tenth, eleventh and twelfth weight members are generally laterally disposed with respect to one another.

22. The device of claim 21, wherein said thirteenth, fourteenth, fifteenth and sixteenth weight members are generally laterally disposed with respect to one another.

23. The device of claim 22, wherein said first weight member is positioned on said index finger-receiving part of said glove member at a location midway between the respective parts of the glove member corresponding to the interphalangeal and metacarpophalangeal joints of an index finger received within said index finger-receiving part of said glove member.

24. The device of claim 23, wherein said second weight member is positioned on said middle finger-receiving part of said glove member at a location midway between the respective parts of the glove member corresponding to the interphalangeal and metacarpophalangeal joints of a middle finger received within said middle finger-receiving part of said glove member.

25. The device of claim 24, wherein said third weight member is positioned on said ring finger-receiving part of said glove member at a location midway between the respective parts of the glove member corresponding to the interphalangeal and metacarpophalangeal joints of a ring finger received within said ring finger-receiving part of said glove member.

26. The device of claim 25, wherein said fourth weight member is positioned on said little finger-receiving part of said glove member at a location midway between the respective parts of the glove member corresponding to the interphalangeal and distal interphalangeal joints of a little finger received within said little finger-receiving part of said glove member.

27. The device of claim 26, wherein said eighteenth weight member is positioned on said middle finger-receiving part of said glove member at a location midway between the respective parts of the glove member corresponding to the interphalangeal and distal interphalangeal joints of a middle finger received within said middle finger-receiving part of said glove member.

28. The device of claim 27, wherein said nineteenth weight member is positioned on said ring finger-receiving part of said glove member at a location midway between the respective parts of the glove member corresponding to the interphalangeal and distal interphalangeal joints of a ring finger received within said ring finger-receiving part of said glove member.

29. The device of claim 28, wherein said first, second, third, fourth, eighteenth and nineteenth weight members are one-quarter ounce in weight.

30. The device of claim 29, wherein said fifth, sixth, seventh, eighth, ninth, tenth, eleventh, twelfth, thirteenth, fourteenth, fifteenth, sixteenth and seventeenth weight members are one-half ounce in weight.

31. The device of claim 30, wherein all of said weight members are one-quarter inch in width and one-half inch in length.

32. The device of claim 31, wherein all of said weight members are positioned in individual weight-receiving pockets that are formed in a top side of said glove member.

33. The device of claim 32, wherein said weight-receiving pockets are formed by thread sewed into said top side of said glove member.

34. The device of claim 33, wherein a longitudinally aligned slot is formed in each of said pockets to provide an access opening for the removal and replacement of said weight members.

35. The device of claim 34, wherein said weight members are held into their respective positions by hook and loop fastening means.

36. The device of claim 19, further comprising a flexible flap member hingedly secured to said glove member at a first side of said hand part of said glove member, said flap member being dimensioned to overlie said fifth through sixteenth weight members.

37. The device of claim 36, further comprising complementary hook and loop fastening means secured to a second side of said hand part of said glove member to releasably secure said flap member in overlying relation to said fifteenth through sixteenth weight members.

38. The device of claim 1, further comprising a shock-absorbing means disposed in underlying relation to said weight member.

39. The device of claim 29, further comprising a shock-absorbing means disposed in underlying relation to said weight member.

40. A weighted glove member having a finger-receiving part, comprising:

at least one weight member disposed in overlying relation to a finger-receiving part of said glove member at a preselected location thereon;

at least one pocket member for maintaining said weight member in said preselected location;

said pocket member including a piece of material disposed in overlying relation to said weight member;

said material being secured to said finger-receiving part of said glove at said material's boundaries to secure said weight member in said preselected location;

a slit means being formed in said material to provide an opening for the insertion and removal of a weight member into and out of said pocket member;

said weight member being generally rectangular in configuration and having a longitudinal axis of symmetry substantially coincident with a longitudinal axis of symmetry of said finger-receiving part of said glove member; and said slit means being substantially coincident with the longitudinal axis of symmetry of said finger-receiving part of said glove member.

41. A weighted glove member having a finger-receiving part, comprising:

at least one weight member disposed in overlying relation to a hand receiving part of said glove member at a preselected location thereon;

at least one pocket member for maintaining said weight member in said preselected location;

said pocket member including a piece of material disposed in overlying relation to said weight member;

said material being secured to said hand receiving part of said glove member at said material's boundaries to secure said weight member in said preselected location;

a slit means being formed in said material to provide an opening for the insertion and removal of a weight member into and out of said pocket member;

said weight member being generally rectangular in configuration and having a longitudinal axis of symmetry substantially coincident with a longitudinal axis of symmetry of a finger-receiving part of said glove member; and said slit means being substantially coincident with the longitudinal axis of symmetry of said weight member.

* * * * *